United States Patent [19]

Ellenbaum et al.

[11] 3,966,456

[45] June 29, 1976

[54] PROCESS OF USING OLIVINE IN A BLAST FURNACE

[75] Inventors: Frank H. Ellenbaum, Hinsdale, Ill.; Richard Ciesco, Griffith, Ind.

[73] Assignee: Molten Metal Engineering Co., Willowbrook, Ill.

[22] Filed: Aug. 1, 1974

[21] Appl. No.: 493,696

[52] U.S. Cl. ..... 75/41; 75/30; 75/94

[51] Int. Cl.[2] ..... C21B 5/04

[58] Field of Search ..... 75/94, 30, 41, 42

[56] References Cited

UNITED STATES PATENTS

| | | | |
|---|---|---|---|
| 2,837,419 | 6/1958 | Sellers et al. | 75/41 |
| 3,264,091 | 8/1966 | Ban | 75/4 |
| 3,396,010 | 8/1968 | Gould | 75/30 |

FOREIGN PATENTS OR APPLICATIONS

| | | | |
|---|---|---|---|
| 46-11412 | 3/1971 | Japan | 75/41 |
| 47-3691 | 2/1972 | Japan | 75/41 |

*Primary Examiner*—M. J. Andrews
*Attorney, Agent, or Firm*—Carl C. Batz

[57] ABSTRACT

A process for the reduction of iron oxides to produce molten iron in which olivine is introduced into a blast furnace in addition to iron oxide bearing materials and in which there is high content of alkali metal oxides in the materials charged into the furnace, resulting in minimizing or preventing "scaffolding" and improving the operation of the blast furnace. The disclosure also includes sinters and briquettes which contain olivine and processes of preparing them, and processes for furnace operation including the charging of such sinters or briquettes.

6 Claims, No Drawings

PROCESS OF USING OLIVINE IN A BLAST FURNACE

This invention relates to a process for producing molten iron in a blast furnace, and more particularly to such a process in which olivine is charged into the blast furnace in addition to the iron ore or other iron oxide bearing materials.

BACKGROUND OF THE INVENTION

The operation of the blast furnace in the production of iron involves processes of chemical reduction in which oxides of iron and other metals are reduced and oxygen removed. The furnace is charged with four basic ingredients; (1) iron oxides, in the form of raw ore, beneficiated pellets, briquettes, nodules, sinters, or other agglomerates. (2) calcium carbonate, (I use the term calcium carbonate to include either limestone or dolomite). (3) a fuel usually in the form of coke. (4) air which provides oxygen to support the combustion. The raw iron ore as it comes from the Lake Superior region contains approximately 50% iron in the form of iron oxide $Fe_2O_3$ and manganese oxide (MnO), with the remainder being silica ($SiO_2$), aluminum ($Al_2O_3$), magnesia (MgO), lime (CaO), sulfur (S), and phosphorus (P). The sulfur and phosphorus are commonly considered impurities.

The iron oxides, or other metallic charge materials, coke and calcium carbonate are charged into the blast furnace, one at a time, in measured amounts to form layers of iron ore, limestone or dolomite, and coke; and air (wind) is passed through these layers and the coke burned. Burning of the coke produces heat and carbon monoxide which has a part in the chemical reduction of the iron oxides. As the coke burns the iron oxides are reduced and come into the form of molten iron. The limestone, or dolomite, along with quantities of impurities such as sulfur and phosphorus, form a slag. The hearth, which is at a lower part of the furnace, is the hottest part of the furnace and the layers of ore, coke and calcium carbonate keep moving downwardly within the furnace to the hearth. At some point in this movement downwardly in the furnace slag is formed, and after its full passage downwardly in the furnace it is withdrawn from the furnace in the form of liquid slag. The slag is important to the operation of the furnace because it carries with it many unwanted impurities and so separates these from the iron and removes them from the furnace.

When the downward movement of the iron bearing charge materials, the coke and the calcium carbonate proceeds in a uniform way with the movement taking place constantly and evenly on all sides of the furnace, this is evidence of good operation. Unfortunately, this is not always the case.

As is well known to blast furnace operators there are times when the downward movement of the ingredients charged into the furnace is not regular and uniform or when the movement on one side of the furnace is greater than on the other side making the furnace unbalanced or "lopsided". There are even times when the downward movement becomes severely restricted, and then after operation for a time under such conditions the whole mass may let loose descending at once into the hot part of the furnace with the result that the hearth temperature is reduced to below an operable temperature, sometimes almost extinguishing the fire. When this happens the furnace may have to be shut down, cleaned and then restarted, which is a time-consuming and expensive operation.

It is our belief that the faulty operation above referred to is due in large part to the presence in the charge materials of a greater than usual content of alkali metal oxides such as $Na_2O$, $K_2O$, $Li_2O$. These oxides appear to pass downwardly to hotter parts of the furnace and there become volatilized after which they pass up the furnace inwalls with the wind and then condense above the mantle of the furnace forming stable alkali-alumino-silicates. Such alkali-alumino-silicates are believed to lead to a scaffolding effect which prevents the layered column of burden material from descending in a regular uniform manner. A continuation of this action develops a situation where the mass will collapse of its own weight, chilling the furnace hearth where the most important smelting reactions take place.

SUMMARY OF THE INVENTION

We have discovered that when processing charge material loads containing alkali metal oxides in excess of about one pound of alkali metal oxides per net ton of molten iron produced, it is possible to improve the operation of the blast furnace, remove a substantial part of the alkali metal oxides in the slag, and prevent the occurrence of falling burden as above described, by charging into the furnace in addition to the regular charge materials having a high alkali metal oxide content a special mineral known as olivine.

DETAILED DESCRIPTION

The olivine above referred to is a special mineral which may be obtained in the form of crushed, sized rock having the following typical analysis:

| | |
|---|---|
| MgO | 40 to 52 weight percent |
| $SiO_2$ | 35 to 45 weight percent |
| FeO | 6.5 to 10 weight percent |

The main component of olivine is forsterite ($2MgO.SiO_2$) which may be contained in an amount of 80 to 95%, usually about 88–90%. Another component is iron silicate ($2FeO.SiO_2$) which may be contained in from about 5 to 12%, usually averaging about 8 to 9%.

The olivine may be charged into the furnace along with the iron ore or other iron oxide bearing charge materials and may be in an amount of from 0.25 to 5.0% by weight of the iron bearing charge materials which are charged into the furnace. Preferably the olivine may be charged into the furnace in an amount within the range of 1.0 to 2.0% by weight of the iron oxide bearing charge materials. We have found that charge materials having a high alkali metal oxide content, in excess of 1 pound per net ton molten metal produced, may be treated to produce molten iron in a blast furnace with much less difficulty when the olivine charge is included.

We do not know with certainty the exact reason for such improvement, but a possible theory explaining the improved results is that the olivine provides a source of useful oxides (MgO, FeO and $SiO_2$) without the evolution of carbon dioxide which is associated with dolomite, for example, and results in raising the point in the geometry of the furnace at which the slag becomes fused, or in other words causes the slag to be formed higher in the furnace, which means that the slag is formed earlier in the total reduction process. This allows more time for the slag reactions to take place and for the impurities to be converted to stable compounds, thus making the process more effective for the removal of sulfur and alkali metal compounds. The tendency for previously fused slag to resolidify is reduced by the relatively earlier slag formation. Further, we believe the earlier slag formation resulting from the introduction of olivine causes the slag to react with more iron oxide surfaces and more $Fe_2O_3$ to be reduced to FeO. Also the olivine itself contains up to 10% FeO which also is reduced in the course of the reduction processes.

The olivine has a tough durable grain with a hardness of about 6.5 to 7.0 on the Mohs Scale and is mechanically strong as compared to limestone or dolomite, and has an advantage in burden permeability and gas-solid contact. Another benefit from the introduction of olivine is in the area of iron chemistry control. Less dust loss and increased carbon monoxide evolution means that control of silicon and manganese reduction are more precise. Heat losses due to calcination are lessened and slag mineralogy improved along with the better control obtained in this improved operation. The earlier formation of liquid slag further permits a more acid slag compostion thus lowering the requirement for basic oxides such as limestone or dolomite.

To demonstrate more specifically how to practice the improved process in which olivine and charge materials having a high alkali metal oxide content are introduced to a blast furnace, we set forth tests which may serve as specific illustrations of how the invention may be practiced and the results which are to be expected.

The following Table I describes a program to be followed over a 30 day period in which the amounts of the materials for one round of charges are listed in the left-hand column. It should be understood that the same amounts and relative proportions of charge materials are continued during the day listed in the Table until the time a different amount of the various charges is prescribed and carried out. The test is begun by accumulating data during a base period. After this the change in the charge is made and continued long enough to provide an evaluation of the operation.

TABLE I

| | |
|---|---|
| Base period — quantities of charge ingredients for one round | |
| Pellets | 29,550 lbs. |
| Mn-Bearing ore | 450 lbs. |
| Scrap | 2,000 lbs. |
| Coke | 14,000 lbs. |
| Dolomite | 3,000 lbs. |
| Limestone | 2,000 lbs. |
| First day of olivine test — quantities/round | |
| Pellets | (same as in base period) |
| Mn-bearing ore | (same as in base period) |
| Scrap | (same as in base period) |
| Coke | (same as in base period) |
| Olivine | 125 lbs. of size −2+½ |
| Dolomite | 2,650 lbs. |
| Limestone | 2,250 lbs. |
| Third day of olivine test — quantities/round | |
| Pellets | (same as in base period) |
| Mn-bearing ore | (same as in base period) |
| Scrap | (same as in base period) |
| Coke | (same as in base period) |
| Olivine | 250 lbs. |
| Dolomite | 2,300 lbs. |
| Calcite Stone | 2,500 lbs. |
| Fifth day of olivine test — quantities/round | |
| Pellets | (same as in base period) |
| Mn-bearing ore | (same as in base period) |
| Scrap | (same as in base period) |
| Coke | (same as in base period) |
| Olivine | 375 lbs. |
| Dolomite | 1,950 lbs. |
| Limestone | 2,750 lbs. |

TABLE I-continued

| | |
|---|---|
| Seventh day of olivine test — quantities/round | |
| Pellets | (same as in base period) |
| Mn-bearing ore | (same as in base period) |
| Scrap | (same as in base period) |
| Coke | (same as in base period) |
| Olivine | 500 lbs. |
| Dolomite | 1,600 lbs. |
| Limestone | 3,100 lbs. |
| Fifth day of olivine test — quantities/round | |
| Pellets | (same as in base period) |
| Mn-bearing ore | (same as in base period) |
| Scrap | (same as in base period) |
| Coke | (same as in base period) |
| Olivine | 375 lbs. |
| Dolomite | 1,950 lbs. |
| Limestone | 2,750 lbs. |
| Seventh day of test — quantities/round | |
| Pellets | (same as in base period) |
| Mn-bearing ore | (same as in base period) |
| Scrap | (same as in base period) |
| Coke | (same as in base period) |
| Olivine | 500 lbs. |
| Dolomite | 1,600 lbs. |
| Limestone | 3,100 lbs. |
| Seventeenth day of test — quantities/round | |
| Pellets | (same as in base period) |
| Mn-bearing ore | (same as in base period) |
| Scrap | (same as in base period) |
| Coke | (same as in base period) |
| Olivine | 600 lbs. |
| Dolomite | 1,200 lbs. |
| Limestone | 3,400 lbs. |
| Eighteenth day of test — quantities/round | |
| Pellets | (same as in base period) |
| Mn-bearing ore | (same as in base period) |
| Scrap | (same as in base period) |
| Coke | (same as in base period) |
| Olivine | 600 lbs. |
| Dolomite | 800 lbs. |
| Limestone | 3,800 lbs. |
| Nineteenth day of test — quantities/round | |
| Pellets | (same as in base period) |
| Mn-bearing ore | (same as in base period) |
| Scrap | (same as in base period) |
| Coke | (same as in base period) |
| Olivine | 600 lbs. |
| Dolomite | 400 lbs. |
| Limestone | 4,200 lbs. |
| Twentieth day of test — quantities/round | |
| Pellets | (same as in base period) |
| Mn-bearing ore | (same as in base period) |
| Scrap | (same as in base period) |
| Coke | (same as in base period) |
| Olivine | 600 lbs. |
| Limestone | 4,200 lbs. |
| Twenty-fifth day of test — quantities/round | |
| Pellets | (same as in base period) |
| Mn-bearing ore | (same as in base period) |
| Scrap | (same as in base period) |
| Coke | (same as in base period) |
| Olivine | 600 lbs. |
| Limestone | 4,600 lbs. |
| Thirtieth day of test — quantities/round | |
| Test terminated. | |

The purpose of the test set forth in Table I is to demonstrate the effect of the olivine on the operation of the blast furnace. As shown in this Table the olivine is increased during the first seven days of the test. The volume of slag may be expected to increase during the test but the basicity and V-ratio will decline. The NaO and $K_2O$ content of the slag may be expected to increase. Since the $Al_2O_3$ content of the slag should be substantially constant the increase in the NaO and $K_2O$ content of the slag may be established by plotting the $NaO/Al_2O$ and the $K_2O/Al_2O_3$ ratios. Also the ratio of CO to $CO_2$ may be determined and plotted to measure furnace efficiency, and if it is determined that more $Fe_2O_3$ is being reduced to FeO this is an indication that the olivine is promoting early slag formation, and an improvement in the coke rate will result. Further, if the furnace starts to peel early in the test, this is an indication the olivine is having a favorable effect.

be incorporated into the iron oxide bearing sinters prior to being charged into the furnace.

We may prepare an olivine sinter charging material by mixing the olivine with the materials of the type heretofore used in the formation of sinters, such as ore fines, mill scale, blast furnace flue dust, limestone or

TABLE II

CHARGE CALCULATIONS IN TEST OF BLAST FURNACE OPERATION

| CHARGE—LBS./ROUND | | SLAG AIM CHEMISTRY CaO | MgO | $SiO_2$ | $Al_2O_3$ | Base/Acid Ratio | SLAG VOLUME LBS./TON of IRON | LENGTH OF PERIOD |
|---|---|---|---|---|---|---|---|---|
| BASE PERIOD—LBS./ROUND | | | | | | | | |
| Erie | 69,500 | | | | | | | |
| Sinter | 13,900 | | | | | | | |
| BOFS | 6,500 | 42 | 12 | 35 | 8.9 | 1.23 | 665 | Indefinitely |
| Dolomite | 6,800 | | | | | | | |
| Coke | 28,000 | | | | | | | |
| 1st TEST PERIOD—LBS./ROUND | | | | | | | | |
| ERIE | 70,000 | | | | | | | |
| Sinter | 15,000 | | | | | | | |
| BOFS | 5,000 | 38.6 | 13.5 | 36.5 | 9.1 | 1.14 | 640 | 10 days |
| Dolomite | 6,000 | | | | | | | |
| Olivine | 1,000 | | | | | | | |
| Coke | 28,000 | | | | | | | |
| 2nd TEST PERIOD—LBS./ROUND | | | | | | | | |
| Erie | 70,000 | | | | | | | |
| Sinter | 15,000 | | | | | | | |
| BOFS | 6,500 | 37.7 | 12.7 | 38.2 | 8.9 | 1.07 | 659 | 5 days |
| Dolomite | 4,000 | | | | | | | |
| Olivine | 1,500 | | | | | | | |
| Coke | 28,000 | | | | | | | |
| 3rd TEST PERIOD—LBS./ROUND | | | | | | | | |
| Erie | 70,000 | | | | | | | |
| Sinter | 15,000 | | | | | | | |
| BOFS | 7,000 | 38.1 | 11.8 | 39.0 | 9.03 | 1.04 | 651 | 5 days |
| Dolomite | 3,000 | | | | | | | |
| Olivine | 1,500 | | | | | | | |
| Coke | 28,000 | | | | | | | |
| 4th TEST PERIOD—LBS./ROUND | | | | | | | | |
| Erie | 70,000 | | | | | | | |
| Sinter | 15,000 | | | | | | | |
| BOFS | 7,000 | 36.7 | 12.8 | 39.1 | 8.8 | 1.03 | 668 | 5 days |
| Dolomite | 3,000 | | | | | | | |
| Olivine | 2,000 | | | | | | | |
| Coke | 28,000 | | | | | | | |
| 5th TEST PERIOD—LBS./ROUND | | | | | | | | |
| Erie | 70,000 | | | | | | | |
| Sinter | 15,000 | | | | | | | |
| BOFS | 8,000 | | | | | | | |
| Dolomite | 2,000 | | | | | | | |
| Olivine | 2,000 | | | | | | | |
| Coke | 28,000 | | | | | | | |

In the above Table II the term:
ERIE means Iron Ore Pellets;
Sinter means Sinter Clinker;
BOFS means Basic Oxygen Furnace Slag Table II describes another series of tests of blast furnace operation in which the ingredients charge in one round are given for a base period in which no olivine is included, and then during subsequent periods in which the olivine is first included at 1,000 lbs./round and in subsequent periods increased up to 2,000 lbs./round.

As shown by the chemical calculations given in Table II the slag volume may increase with increased amounts of olivine, and the base-acid ratio decreases. An increase of the alkali metal compounds in the slag may be expected, and a noticeable improvement in the operation of the furnace.

It is an added feature of our invention that instead of charging a self-contained volume of olivine into the furnace the olivine may be premixed with another of the charging ingredients such as the coke. Also it may dolomite, and then firing the mixture to produce the sinter material. The sinters thus produced may then be used as an ingredient in the charging of the blast furnace.

The olivine may also be used in a similar way to prepare briquettes to be used as a blast furnace charging ingredient. In this case, the mixture of materials are mixed with the olivine, fired, and pressed into the form of briquettes, and the briquettes charge as one of the charging ingredients into a blast furnace.

To demonstrate the preparation of sinters or briquettes for use as blast furnace charging materials we give in Table III the materials and proportions included in a typical mixture which may be formed into sinters or briquettes.

TABLE III

| Materials | Weight Percent |
|---|---|
| Ore Fines | 30 to 50 |
| Mill Scale | 10 to 25 |
| Blast Furnace Flue Dust | 5 to 15 |
| Coke Breeze | 1 to 5 |
| Limestone Fines | 1 to 10 |
| Dolomite Fines | 1 to 10 |
| Olivine Fines | 0.25 to 10.0 |

Alternatively, the olivine may be mixed with coke and the mixture of coke and olivine may then be formed into coke briquettes in a manner similar to that heretofore used in making coke briquettes, and these coke briquettes containing olivine may be charged as one of the charging ingredients into a blast furnace. The olivine may be mixed with the coke in any proportion; for example, in an amount of from 0.25–10.0 weight percent of the mixture of preferably from 0.5 to 5.0.

We find that a substantial additional advantage is gained when the olivine is premixed with materials from which sinters or briquettes are made. We cannot say with certainty the exact reason for the improved results from such practice, but it is possible that the results may be at least partially explained by the fact that the olivine is found to come into better physical distribution in a blast furnace when this practice is followed. This results in the abatement of "bridging" or scaffolding throughout the layers formed by the different charging ingredients.

While in the foregoing detailed description only certain embodiments of the invention are set forth, it is understood that many embodiments may be practiced and many changes and variations may be made all within the spirit of the invention and the scope of the appended claims.

We claim:

1. In a process for producing iron in a blast furnace wherein charge materials including iron oxide bearing materials, calcium carbonate and coke, are charged into the blast furnace to form within the furnace layers of iron oxide bearing materials, calcium carbonate and coke and wherein air is passed upwardly through said layers, and said coke is burned to heat said materials and reduce iron oxides to produce molten iron, said charge materials having an alkali metal oxide content exceeding 1 pound per ton of molten iron produced, the improvement which includes charging into said blast furnace in addition to said iron oxide materials from 0.25 to 5 percent of olivine, said percentage being based on the weight of said iron oxide materials.

2. A process as set forth in claim 1 in which a part of said iron oxide bearing materials is in the form of sinters.

3. A process as set forth in claim 2 including the step of mixing said olivine with iron oxide bearing materials and burning the same to form sinters, and introducing said sinters into said furnace as a charge material.

4. A process as set forth in claim 1 including the steps of mixing said olivine with coke in particulate form, forming briquettes of said mixture, and charging the briquettes into said furnace as a charging ingredient.

5. A process as set forth in claim 3 which includes the step of forming said sinters into briquette form prior to charging the same into the furnace.

6. A process as set forth in claim 1 wherein said olivine is charged into said furnace in an amount of from 1.0 to 2.0 percent by weight of the iron oxide bearing charge materials.

* * * * *